US010669867B2

(12) United States Patent
Chen et al.

(10) Patent No.: US 10,669,867 B2
(45) **Date of Patent: *Jun. 2, 2020**

(54) ELECTRODEPOSITED NICKEL-CHROMIUM ALLOY

(71) Applicants: Lei Chen, South Windsor, CT (US); Zhiwei Yang, South Windsor, CT (US); William J. Brindley, Hebron, CT (US); Monika D. Kinstler, Manchester, CT (US); Bruce R. Saxton, West Suffield, CT (US)

(72) Inventors: Lei Chen, South Windsor, CT (US); Zhiwei Yang, South Windsor, CT (US); William J. Brindley, Hebron, CT (US); Monika D. Kinstler, Manchester, CT (US); Bruce R. Saxton, West Suffield, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 960 days.

This patent is subject to a terminal disclaimer.

(21) Appl. No.: 15/103,077

(22) PCT Filed: Dec. 3, 2014

(86) PCT No.: PCT/US2014/068445

§ 371 (c)(1),
(2) Date: Jun. 9, 2016

(87) PCT Pub. No.: WO2015/088859

PCT Pub. Date: Jun. 18, 2015

(65) Prior Publication Data

US 2016/0312627 A1 Oct. 27, 2016

Related U.S. Application Data

(60) Provisional application No. 61/914,313, filed on Dec. 10, 2013.

(51) Int. Cl.
*F01D 5/28* (2006.01)
*C25D 5/50* (2006.01)
(Continued)

(52) U.S. Cl.
CPC ..... *F01D 5/288* (2013.01); *C22C 19/058* (2013.01); *C25D 3/12* (2013.01); *C25D 3/562* (2013.01);
(Continued)

(58) Field of Classification Search
CPC ... C23C 28/022; C23C 28/3215; C25D 3/665; C25D 3/12–18
See application file for complete search history.

(56) References Cited

U.S. PATENT DOCUMENTS 2,763,921 A 9/1956 Turner et al.
3,338,733 A 8/1967 Rowady
(Continued)

FOREIGN PATENT DOCUMENTS

CA 2854367 A1 5/2013
EP 2623644 A1 8/2013
(Continued)

OTHER PUBLICATIONS

European Search Report for European Application No. 14869187.6, dated Jul. 11, 2017, 10 pages.
(Continued)

*Primary Examiner* — Brian W Cohen
*Assistant Examiner* — Ho-Sung Chung
(74) *Attorney, Agent, or Firm* — Cantor Colburn LLP

(57) ABSTRACT

A nickel-chromium (Ni—Cr) alloy and a method for electrodepositing the Ni—Cr alloy on a turbine engine component for dimensionally restoring the engine component are described. The engine component is restored by re-building wall thickness with the Ni—Cr alloy including from 2 to 50
(Continued)

wt % chromium balanced with nickel. The turbine component coated with the Ni—Cr alloy is heat-treated at a high temperature to homogenize composition of the alloy to mimic the base alloy and to restore materials lost during repair of the turbine component.

15 Claims, 3 Drawing Sheets

(51) Int. Cl.

| | |
|---|---|
| ***C25D 3/66*** | (2006.01) |
| ***C25D 3/56*** | (2006.01) |
| ***C22C 19/05*** | (2006.01) |
| ***C25D 3/12*** | (2006.01) |
| ***C25D 5/40*** | (2006.01) |
| ***C25D 7/00*** | (2006.01) |
| ***F01D 9/02*** | (2006.01) |
| ***F01D 25/00*** | (2006.01) |
| ***C25D 5/18*** | (2006.01) |

(52) U.S. Cl.

CPC ..... *C25D 3/665* (2013.01); *C25D 5/40* (2013.01); *C25D 5/50* (2013.01); *C25D 7/00* (2013.01); *F01D 9/02* (2013.01); *F01D 25/005* (2013.01); *F01D 25/007* (2013.01); *C25D 5/18* (2013.01); *F05D 2220/30* (2013.01); *F05D 2230/30* (2013.01); *F05D 2230/80* (2013.01); *F05D 2230/90* (2013.01); *F05D 2300/132* (2013.01); *F05D 2300/175* (2013.01); *F05D 2300/177* (2013.01)

(56) References Cited

U.S. PATENT DOCUMENTS

| | | | | |
|---|---|---|---|---|
| 3,748,110 | A | 7/1973 | Hodshire et al. | |
| 3,763,002 | A | 10/1973 | Skomoroski et al. | |
| 3,810,782 | A | 5/1974 | Gallmiche | |
| 3,917,517 | A | 11/1975 | Jordan et al. | |
| 3,998,603 | A * | 12/1976 | Rairden, III | C23C 14/16 428/651 |
| 4,153,453 | A | 5/1979 | Hart et al. | |
| 4,461,680 | A | 7/1984 | Lashmore | |
| 5,126,213 | A | 6/1992 | Restall | |
| 5,543,183 | A | 8/1996 | Streckert et al. | |
| 5,908,285 | A | 6/1999 | Graff | |
| 7,285,337 | B2 | 10/2007 | Narita et al. | |
| 10,378,118 | B2 * | 8/2019 | Chen | C25D 1/00 |
| 2002/0130047 | A1 | 9/2002 | Allen et al. | |
| 2004/0054231 | A1 | 3/2004 | Abbott et al. | |
| 2006/0029723 | A1 * | 2/2006 | Rigney | B23P 6/002 427/8 |
| 2006/0251916 | A1 | 11/2006 | Arikawa et al. | |
| 2007/0059486 | A1 * | 3/2007 | Anton | B23P 6/007 428/131 |
| 2008/0017280 | A1 | 1/2008 | Vargas et al. | |
| 2010/0252446 | A1 | 10/2010 | Kuzmanovic et al. | |
| 2011/0065804 | A1 | 3/2011 | Diaddario et al. | |
| 2013/0168825 | A1 | 7/2013 | Bhattacharya | |
| 2013/0199934 | A1 | 8/2013 | Parkos, Jr. et al. | |
| 2014/0007988 | A1 * | 1/2014 | Ozbaysal | C22C 19/055 148/528 |
| 2016/0002803 | A1 | 1/2016 | Sklar | |
| 2016/0312614 | A1 | 10/2016 | Chen et al. | |
| 2016/0320502 | A1 | 11/2016 | Chen et al. | |
| 2019/0072683 | A2 | 3/2019 | Chen et al. | |

FOREIGN PATENT DOCUMENTS

| | | | |
|---|---|---|---|
| GB | 749909 | A | 6/1956 |
| GB | 1233090 | A | 5/1971 |

OTHER PUBLICATIONS

Saravanan et al., "Electrodeposition of Fe—Ni—Cr alloy from Deep Eutectic System containing Choline chloride and Ethylene Glycol", International Journal of Electrochemical Science, vol. 6, 2011, pp. 1468-1478.

Xu et al., "Ni—Cr alloy electrodepositing technology on Fe substrate and coating performance", Journal of Central South University of Technology, vol. 14, No. 2, 2007, pp. 181-185.

Liana Anicia, Andreea Florea and Teodor Visan (2011). Steudies Regarding teh Nickel Electrodeposition Choline Chloride Based Ionic Liquids, Applications of Ionic Liquids in Science and Technology, Prof. Scott Handy (Ed.), ISBN: 978-953-307-605-8 (Year: 2011).

Y.H. You et al./Surface & Coatings Technology 206 (2012) 3632-3638 (Year: 2012).

Abbott et al., "Ionic Liquid Analogues Formed from Hydrated Metal Salts", Chemical European Journal, vol. 10, 2004, pp. 3769-3774.

European Search Report for European Application No. 14869585.1 dated Jul. 11, 2017, 25 pages.

European Search Report for European Application No. 14870576.7, dated Jul. 11, 2017, 10 pages.

International Search Report and Written Opinion for International Application No. PCT/ US2014/068580, dated Feb. 11, 2015.

International Search Report for Application No. PCT/US14/68447; dated Feb. 11, 2015.

Written Opinion for International Application No. PCT/US14/68447; dated Feb. 11, 2015.

"INCONEL alloy 625"; Aug. 13, 2013; Special Metals Corportation, Table 1; 18 pgs.

International Search Report for International application No. PCT/US14/68445; International filing date: Dec. 3, 2014; dated Oct. 16, 2015; 4 pgs.

International Written Opinion for International application No. PCT/US14/68445; International filing date: Dec. 3, 2014; dated Oct. 16, 2015; 4 pgs.

Endres et al,, Electrodeposition from Inoic Liquids 353 (Year: 2008), 15 pages.

Lou et al., Electroplating, Encyclopedia of Chem. Proc. (Year: 2006), 10 pages.

* cited by examiner

ELECTRODEPOSITED NICKEL-CHROMIUM ALLOY

CROSS REFERENCE TO RELATED APPLICATIONS

This application is a National Phase Application of Patent Application PCT/US2014/068445 filed on Dec. 3, 2014, which claims priority to U.S. Provisional Application No. 61/914,313 filed on Dec. 10, 2013 and titled Electrodeposited Nickel-Chromium Alloy, the disclosure each of which is hereby incorporated by reference in its entirety.

FIELD OF USE

The present disclosure relates to an electrodeposited nickel-chromium (Ni—Cr) alloy that can be coated on turbine engine components intended to operate in hostile environments to provide improved resistance to oxidation, hot corrosion, and/or erosion. Specifically, the present disclosure relates to processes and chemistry used to repair engine components that have been damaged in service by adding wall thickness to restore the dimension of those components for extended useful life. The added materials include primarily electrodeposited Ni—Cr alloy.

BACKGROUND

High and low pressure turbine engine components like vanes, stators, and rotor blades are made of nickel based superalloys. Typically, these components are protected from the high temperature environment by a thermal barrier coating (TBC). However, the coating can be damaged due to oxidation, corrosion, and/or erosion during service, requiring scheduled repairs or being scrapped if material loss has thinned down the wall of the structure below allowable limits.

Traditional repair methods entail removing the existing coatings and apply new coatings to the engine components. The repair process generally causes material loss of the base metal. As the wall thickness approach allowable limit as a result of repair, the engine parts can no longer be reused. Therefore, dimensional restoration in engine repair service can lead to economic gain and reduce the amount of scrap parts that still have substantial remaining material value.

One of the current practices of engine repair is to deposit nickel (Ni) onto the damaged parts followed by a high temperature diffusion process to convert the nickel deposit to a desired alloy composition. While diffusion of chromium (Cr) into the Ni deposit layer can enhance the high temperature oxidation resistance of the repaired part, the diffusion process can gradually consume the chromium (Cr) and other minor compositions from the parent parts, i.e., vanes.

Since the major composition of the vanes is Ni and Cr, plating a Ni—Cr alloy to satisfy the composition requirement can greatly retard or even reverse the depletion of the Cr from the parent parts. Thus, Ni—Cr deposit is attractive to enable engine dimensional restoration.

Electrodeposition is a non-light-of-sight coating application technique suitable for the parts with complex geometry, such as engine vanes and airfoils. Electrodeposition of Ni—Cr alloy in traditional plating chemistry has not been successful in forming a deposit thick enough for the structural repair (>125 μm) with dense structure. The challenge is suspected to be related to the inability to deposit thick Cr deposits greater than 10 μm from conventional aqueous trivalent chromium plating baths.

Although thick hard chromium has been produced in hexavalent chromium solution, i.e. chromic acid, the hard chromium deposit has cracks and hexavalent chromium is highly carcinogenic. Therefore, it is desirable to develop plating chemistry using only trivalent chromium as the Cr source to produce Ni—Cr alloys for the engine dimensional restoration applications.

SUMMARY

According to an aspect of the present disclosure, a coated article is disclosed. The coated article includes a turbine component and a Ni—Cr alloy coated on a surface of the turbine component, wherein the Ni—Cr alloy includes from 2 to 50 wt % chromium and a remaining weight percentage of nickel, and wherein the Ni—Cr alloy is heat-treated to homogenize the composition similar to that of the base metals to restore the wall thickness reduced during repair of the turbine component. The electrodeposited Ni—Cr alloy is thicker than 2 mils (0.05 mm) It is desirable to apply a thick Ni—Cr deposit with sufficiently high Cr content to increase repair cycles of the turbine engine components.

According to another aspect of the present disclosure, a method for electrodepositing a thick nickel-chromium (Ni—Cr) alloy suitable to be plated on a turbine component is disclosed. The method includes pre-treating the turbine component prior to electrodeposition. The method further includes providing a plating bath filled with a solution including a solvent, a surfactant, and an ionic liquid (deep eutectic solvent) including choline chloride, nickel chloride, and chromium chloride, wherein a molar ratio of the choline chloride, the combined chromium chloride, and nickel chloride ranges from 0.5 to 3.5, and the solvent amounts to 5 to 80 vol. % (pre-mixing volume) relative to a mixture of the choline chloride and metal chlorides.

The method further includes electrodepositing a Ni—Cr alloy on a metallic substrate cathode while using an anode that is either insoluble or soluble such as nickel under electrolytic conditions. Specifically, the insoluble anode is used to promote the oxidation of water to produce oxygen as the main by-product while other minor products can be produced concurrently as well. The soluble nickel anode is used to replenish the nickel deposited on the cathode. Alternating use of the combined insoluble and soluble (active) anodes is also included in this method to attain plating bath composition control. An external power supply is used for the electrodepositon and the current or potential can be regulated to achieve desired deposit properties such as adhesion, grain structure, hardness and residual stress. The electrodeposited Ni—Cr alloy is subsequently heat-treated to replenish the materials lost during repair of the turbine component and homogenize the composition.

The details of one or more embodiments of the present disclosure are set forth in the accompanying drawings and the description below. Other features, objects, and advantages of the present disclosure will be apparent from the description and drawings, and from the claims.

The drawings depict various preferred embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Typically, electroplating is a process that uses electrical current to reduce dissolved metal ions, most likely metal ion complexes so that they form a coherent metal coating on an electrode that is, for example, a turbine engine component to be repaired. The process used in electroplating is called electrodeposition. The part to be plated with Ni—Cr alloy is a cathode, and an anode is made of such metal as Ni, Cr, Ni—Cr alloy, or any combination of these materials to be plated on the part, according to an embodiment. In another embodiment, an insoluble catalytic anode (e.g., iridium oxide, tantalum oxide, ruthenium oxide, or the like) can be used. Yet in another embodiment, an insoluble catalytic anode is used in conjunction with a soluble anode, and the soluble anode can be optionally used to adjust the bath composition as desired.

Figure 1:
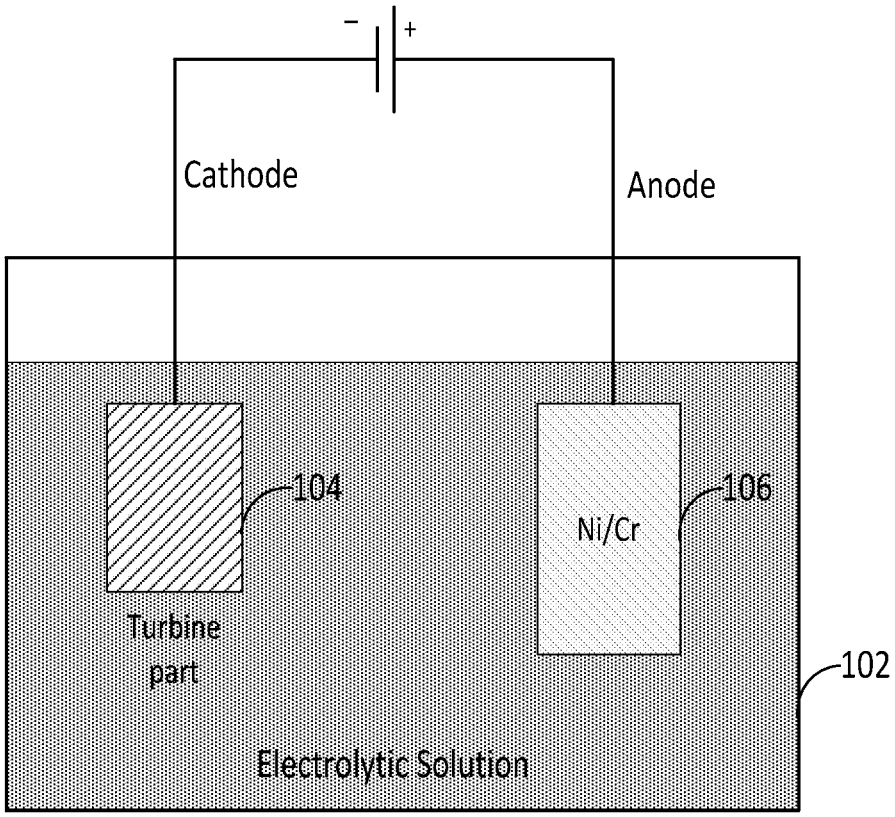
FIG. 1 illustrates a plating bath filled with an electrolytic solution for electrodepositing a Ni—Cr alloy on turbine engine parts with a combined soluble and insoluble anode according to an aspect of the present disclosure.

FIG. 1 illustrates an electroplating bath filled with an electrolytic solution for electrodepositing a Ni—Cr alloy suitable to be plated on a turbine engine part to be repaired according to an aspect of the present disclosure. The part to be plated is pre-treated prior to electrodeposition. The pre-treatment includes removing the existing coating, mechanically cleaning the surface, degreasing, acid or alkaline etching including electro-etching and final activation before the part is placed in the plating bath for deposit application. The electrodeposition inevitably decomposes water in the bath 102, and thus the solution in the bath needs to be replenished to maintain consistent deposition quality.

Referring now to FIG. 1, there is provided a plating bath 102 containing an electrolytic solution that consists of a room temperature ionic liquid, namely deep eutectic solvent, including choline chloride, nickel chloride, chromium chloride, solvents, and surfactants including anionic, cationic, or Zwitterionic (amphoteric) surfactants. An example of the surfactant is a sodium dodecyl surfate, fluorosurfactants, cetyl trimethylammonium bromide (CTAB), or cetyl trimethylammonium chloride (CTAC). It is noted that the choline chloride based metal processing is low-cost and environmentally friendly. In one embodiment, a molar ratio of the choline chloride and chromium chloride ranges from 0.5 to 3.5.

In one embodiment, polar aprotic and polar protic solvents are used to adjust the viscosity and conductivity of the plating bath 102 to attain a high quality Ni—Cr alloy coating. Specifically, protic solvents are preferred due to their hydrogen bond donating ability. The solvents include formic acid, citric acid, Isopropanol (IPA), water, acetic acid, glycine (aminoacetic acide) and ethylene glycol.

In the embodiment, preferred solvent content is from 10 to 80 vol % relative to the mixture of choline chloride and metal chlorides including the nickel and chromium chlorides on a pre-mixing basis. Referring to FIG. 1, electroplating of the Ni—Cr alloy begins by providing an external supply of current to an anode and a cathode that is the part to be repaired. An external supply of the current can be a direct current or an alternating current including a pulse or pulse reverse current (not shown). The regime and magnitude of the current can be controlled during the deposition to achieve desired coating composition, density, and morphology.

The turbine part 104 to be plated is a cathode during electrodeposition. The anode 106 is, for example, a Ni—Cr alloy anode, a Ni and/or Cr anode, or any combination of these materials that can be chosen to satisfy different requirements. An insoluble catalytic anode (catalyzing oxygen evolution to suppress or eliminate other undesirable anodic reactions such as chlorine evolution, hexavalent chromium formation) is preferable, but the anode used is not specifically limited. A combination of soluble Ni anode and an insoluble catalytic anode can be used to control bath composition during the course of plating as well.

Figure 2A:
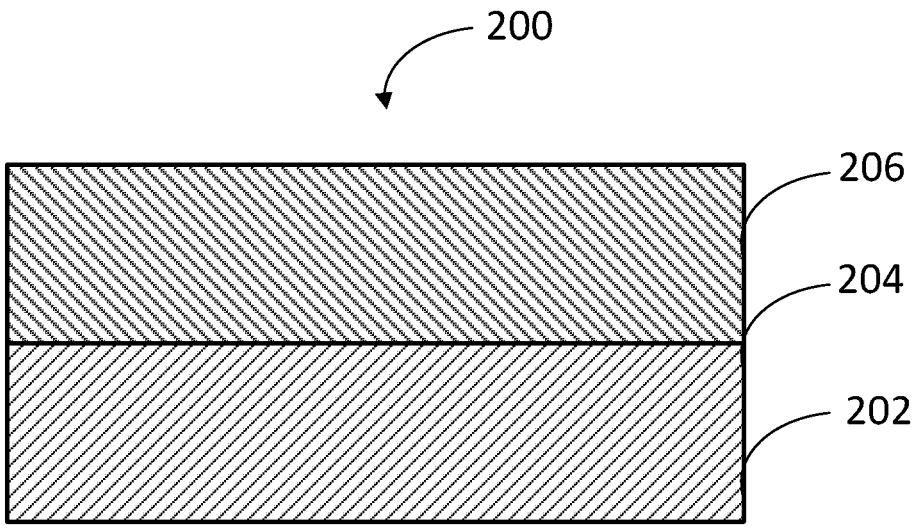
FIG. 2A illustrates a cross-sectional view of an article as coated with Ni—Cr alloy formed by electrodeposition.

FIG. 2A illustrates an article 200 as-coated by an electrodeposited Ni—Cr alloy 206. Referring to FIG. 2A, a part 202 includes a turbine component that has at least one surface 204. A Ni—Cr alloy deposit 206 on the surface 204 of the turbine part 202 adds wall thickness and the chromium lost during repair of the part. The coated Ni—Cr alloy is compatible with the material forming the turbine part 202. The coating 206 may be applied directly to the surface 204 of the turbine part 202 which is formed from a wide range of metallic materials including, but not limited to, a single crystal nickel-based superalloy.

Figure 2B:
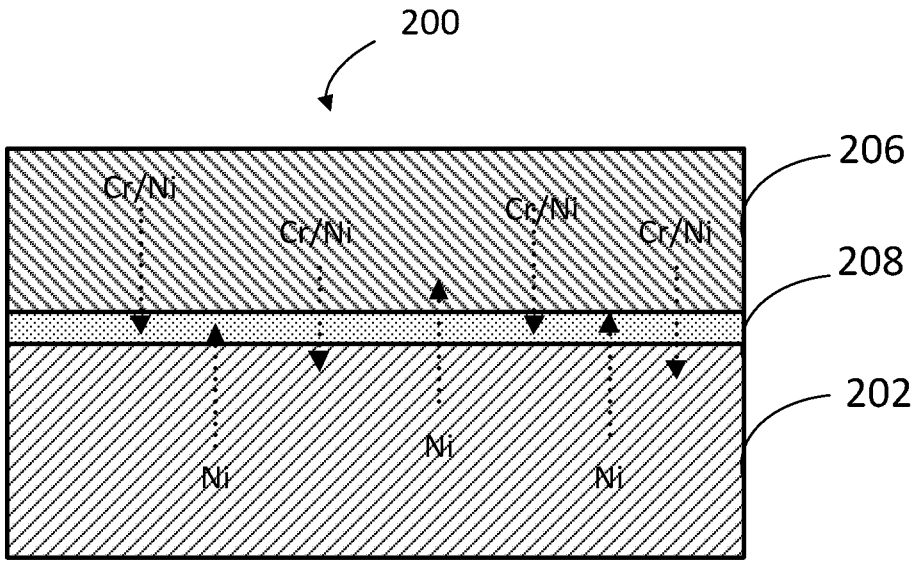
FIG. 2B illustrates a cross-sectional view of an article of FIG. 2A after high temperature heat treatment to homogenize the composition.

The Ni—Cr alloy coating 206 is subsequently heat-treated at high temperature (over 1000° C.) to allow inter-diffusion of elements, resulting in homogenized composition in the restored wall. FIG. 2B illustrates a cross-sectional view of an article of FIG. 2A after high temperature heat treatment with a schematic inter-diffusion zone 208. Referring to FIG. 2B, an interdiffusion zone 208 is formed along the interface region between the turbine part 202 and the Ni—Cr alloy coating 206 as result of the high temperature heat-treatment.

Figure 3:
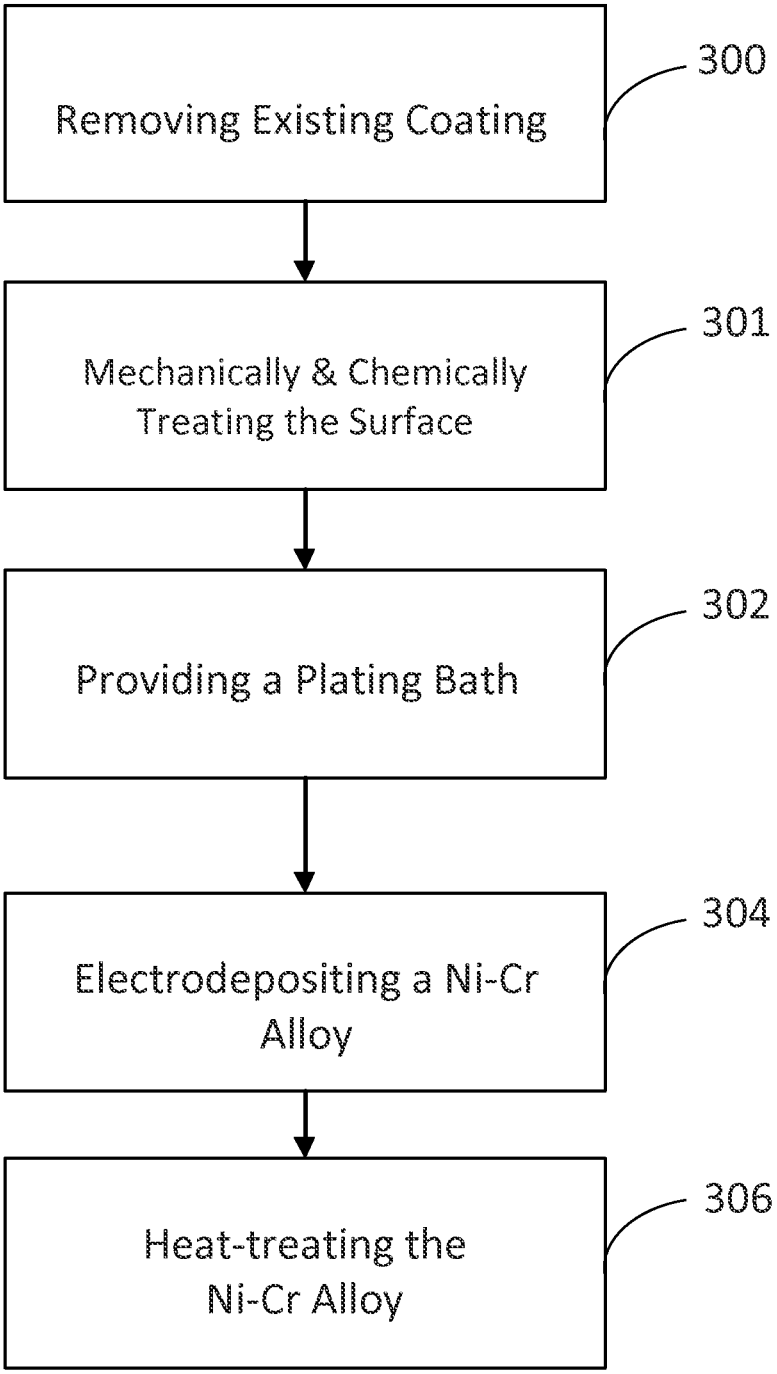
FIG. 3 is a flow chart of the process for electrodepositing a Ni—Cr alloy for dimensional restoration of an engine component.

FIG. 3 is a flow chart of an electrodeposited Ni—Cr coating process of the present disclosure. Forming a Ni—Cr deposit of substantial thickness, for example, over 1 mil (0.025 mm), by electrodepositing a Ni—Cr alloy on a turbine part begins at step 300 where the coating and damaged surface of the turbine part is first removed and cleaned down to the base alloy. Then, a mechanical and chemical cleaning of the part is carried out and the cleaned surface is then activated at step 301 prior to being placed into the plating bath for electrodeposition. At step 304, the Ni—Cr alloy is electrodeposited on a metallic substrate of the turbine part by providing an external supply of current to an anode and the cathode. The electrodeposited Ni—Cr alloy is then heat-treated at step 306 to restore materials lost during repair of the turbine component and homogenize the composition.

In an embodiment, the electrodeposited Ni—Cr alloy formed by the method disclosed above comprises from 2 to 50 wt % chromium balanced by nickel, and is capable of rebuilding a vane wall by more than 2 mils (0.05 mm) In another embodiment, the electrodeposited Ni—Cr alloy formed by the method disclosed above comprises from 8 to 20 wt % chromium balanced by nickel, and is capable of rebuilding a turbine component wall by more than 5 mils (0.125 mm) The turbine component to be plated includes a vane, a rotor blade, or a stator.

The Ni—Cr alloy plated on the aero-engine parts including vanes minimizes the loss of key elements like chromium during repair services that are critical to high temperature oxidation resistance. Thus, the electrodeposited Ni—Cr alloy that is plated on the turbine parts extends the repair cycles of the parts. The electrodeposited Ni—Cr alloy is subject to the post heat treatment at high temperature (usually over 1000° C.) to homogenize the composition of the alloy and to restore materials lost during the repair of the turbine engine parts.

The disclosed choline chloride based electrodeposition is a metal forming process that is cost-effective to restore dimensions of high temperature turbine parts with complex geometries and tighter tolerance, and is environmentally friendly.

It is to be understood that the disclosure of the present invention is not limited to the illustrations described and shown herein, which are deemed to be merely illustrative of the best modes of carrying out the invention, and which are susceptible to modification of form, size, arrangement of parts, and details of operation. The disclosure of the present invention rather is intended to encompass all such modifications which are within its spirit and scope of the invention as defined by the following claims.

What is claimed is:

1. A method for electrodepositing a nickel-chromium (Ni—Cr) alloy plated on a turbine component, the method comprising:

pre-treating the turbine component;

providing a plating bath containing a solvent, a surfactant, and an ionic liquid including choline chloride, nickel chloride, and chromium chloride, wherein a molar ratio of the choline chloride, combined chromium chloride, and nickel chloride ranges from 0.5 to 3.5, and the solvent comprises from 5 to 80 vol. % relative to a volume of a mixture of the choline chloride and metal chlorides including both nickel chloride and chromium chloride;

electrodepositing the Ni—Cr alloy onto a metallic substrate by providing an external supply of current to an anode and a cathode; and heat-treating the turbine component coated with Ni—Cr alloy to re-build wall thickness and restore materials lost during repair of the turbine component.

2. The method according to claim 1, wherein the anode is an insoluble anode.

3. The method according to claim 1, wherein the anode is a Ni—Cr alloy anode.

4. The method according to claim 1, wherein the anode includes is a Ni anode and a Cr anode.

5. The method according to claim 1, wherein the current is a direct current.

6. The method according to claim 1, wherein the current is an alternating current.

7. The method according to claim 1, wherein the solvent is a polar protic solvent.

8. The method according to claim 1, wherein the solvent is a polar aprotic solvent.

9. The method according to claim 1, wherein the solvent is chosen from one or more of formic acid, citric acid, isopropanol (IPA), water, acetic acid, glycine (amino-acetic acid), and ethylene glycol.

10. The method according to claim 1, wherein the surfactant is an anionic, a cationic, or an amphoteric surfactant.

11. The method according to claim 1, wherein the surfactant is sodium dodecyl sulfate; fluorosurfactants, cetyl trimethylammonium bromide (CTAB), or cetyl trimethylammonium chloride (CTAC).

12. The method according to claim 1, wherein the Ni—Cr alloy compromises from 8 to 20 wt % chromium balanced by nickel.

13. The method according to claim 1, wherein the Ni—Cr alloy is thicker than 2 mils (0.05 mm).

14. The method according to claim 1, wherein the Ni—Cr alloy is thicker than 5 mils (0.125 mm).

15. The method according to claim 1, wherein the turbine component is a rotor blade, a stator, or a vane.

* * * * *